US010871158B2

(12) United States Patent
Schwarzer et al.

(10) Patent No.: US 10,871,158 B2
(45) Date of Patent: Dec. 22, 2020

(54) PUMP ASSEMBLY FOR A PUMP, PUMP, AND METHOD FOR REDUCING OR ELIMINATING DISTURBING NOISES AND / OR VIBRATIONS IN PUMPS

(71) Applicant: Schwarzer Precision GmbH & Co. KG, Essen (DE)

(72) Inventors: Marcus Schwarzer, Essen (DE); Heiko Hoffmann, Dortmund (DE)

(73) Assignee: SCHWARZER PRECISION GMBH & CO. KG, Essen (DE)

( * ) Notice: Subject to any disclaimer, the term of this patent is extended or adjusted under 35 U.S.C. 154(b) by 195 days.

(21) Appl. No.: 15/646,700

(22) Filed: Jul. 11, 2017

(65) Prior Publication Data

US 2018/0017053 A1 Jan. 18, 2018

(30) Foreign Application Priority Data

Jul. 13, 2016 (DE) ..... 10 2016 008 421
Oct. 14, 2016 (DE) ..... 10 2016 012 252

(51) Int. Cl.

| | |
|---|---|
| ***F04B 45/047*** | (2006.01) |
| ***F04B 43/02*** | (2006.01) |
| ***F04B 43/04*** | (2006.01) |
| ***F04B 45/04*** | (2006.01) |
| ***F04B 53/00*** | (2006.01) |
| ***F04B 53/16*** | (2006.01) |

(52) U.S. Cl.

CPC ..... *F04B 45/047* (2013.01); *F04B 43/02* (2013.01); *F04B 43/04* (2013.01); *F04B 45/04* (2013.01); *F04B 53/003* (2013.01); *F04B 53/16* (2013.01); *F04B 43/043* (2013.01)

(58) Field of Classification Search

CPC .... F04B 29/041; F04B 29/048; F04B 29/051; F04B 29/058; F04B 53/003; F04B 43/02–04; F04B 45/04–047; F04B 53/001; F04D 29/041; F04D 29/048; F04D 29/051; F04D 29/058; F04D 53/003

USPC ..... 417/365, 423.1, 423.3, 423.6–423.14, 417/412, 413.1, 415; 92/96–99

See application file for complete search history.

(56) References Cited

U.S. PATENT DOCUMENTS 4,717,315 A 1/1988 Miki et al.
5,613,831 A * 3/1997 Liegat ..... F04D 29/041 415/229

(Continued)

FOREIGN PATENT DOCUMENTS

JP 55060719 A * 5/1980 ..... F16C 32/0431

*Primary Examiner* — Alexander B Comley
(74) *Attorney, Agent, or Firm* — Jason H. Vick; Sheridan Ross, PC

(57) ABSTRACT

What is illustrated and described is a pump assembly (1) for a pump, particularly for a miniature pump, with an electric motor (2) and with a housing unit (3), wherein the electric motor (2) has a motor shaft (5) passing freely through a motor housing of the electric motor (2) and the motor housing is connected to the housing unit (3), and wherein the motor shaft (5) is supported in the motor housing with an axial shaft play. According to the invention, at least one stabilizing element (6, 13, 14, 16) arranged outside of the motor housing is provided in order to reduce or eliminate the axial play of the motor shaft (5), with an axial compressive force or axial tensile force acting on the motor shaft (3) being applied by the stabilizing element (6, 13, 14, 16) to the motor shaft (5).

12 Claims, 3 Drawing Sheets

(56) References Cited

U.S. PATENT DOCUMENTS

| | | | | |
|---|---|---|---|---|
| 6,350,109 | B1 * | 2/2002 | Brunet | F04D 29/0465<br>417/365 |
| 6,796,764 | B2 * | 9/2004 | Motojima | F02C 7/22<br>415/200 |
| 6,877,963 | B2 * | 4/2005 | Beyer | F04D 19/048<br>310/90.5 |
| 2007/0166175 | A1 * | 7/2007 | Manke | F04B 39/0094<br>417/365 |
| 2007/0177995 | A1 * | 8/2007 | Yano | F04D 13/025<br>417/365 |
| 2011/0181140 | A1 * | 7/2011 | Scherrer | F04D 25/0653<br>310/90.5 |

* cited by examiner

PUMP ASSEMBLY FOR A PUMP, PUMP, AND METHOD FOR REDUCING OR ELIMINATING DISTURBING NOISES AND / OR VIBRATIONS IN PUMPS

CROSS REFERENCE TO RELATED APPLICATIONS

This application claims priority to German Patent Application No. 10 2016 008 421.9 filed on Jul. 13, 2016 and German Patent Application No. 10 2016 012 252.8 filed on Oct. 14, 2016, each of which are incorporated herein by reference in their entirety.

The invention relates to a pump assembly for a pump, particularly for a miniature pump, more particularly for a miniature diaphragm pump, preferably with a delivery volume of less than 10 L/min, more preferably of less than 1000 mL/min, especially preferably with a delivery volume of less than 500 mL/min, with an electric motor, particularly a direct-current motor, and with a housing unit, wherein the electric motor has a freestanding motor shaft passing freely through a motor housing of the electric motor and the motor housing is connected to the housing unit, and wherein the motor shaft is supported in the motor housing with an axial shaft play. In particular, the motor shaft is supported in the motor housing by a slide bearing.

Moreover, the present invention relates to a pump, particularly a miniature pump, more preferably a miniature diaphragm pump, preferably with a delivery volume of less than 10 L/min, more preferably of less than 1000 mL/min, especially preferably with a delivery volume of less than 500 mL/min, with a pump assembly of the type described above.

Finally, the invention relates to a method for reducing or eliminating noises and/or vibrations in pumps, particularly in miniature pumps, more particularly in miniature diaphragm pumps, with the pump preferably having a delivery volume of less than 10 L/min, more preferably of less than 1000 mL/min, especially preferably of less than 500 mL/min, with the pump having a pump assembly with an electric motor, particularly a direct-current motor, and a housing unit, with the electric motor having a freestanding motor shaft passing freely through a motor housing of the electric motor and the motor housing being connected to the housing unit, and with the motor shaft being supported in the motor housing with an axial shaft play.

There are many areas in which miniature pumps can be used. In the area of medical technology, for example, miniature pumps are used in the treatment of sleep disorders/sleep apnea syndrome, with the patient wearing a nose or face mask connected via a tube to a miniature pump while sleeping. The air is pumped actively through the nose into the lung, so that the airway remains open due to the positive pressure. In wound drainage, a miniature pump is used to apply a vacuum to a wound dressing in order to improve the healing of the wound. Miniature pumps of the type being discussed are also used in surgical aspirators for providing suction in medical applications, in medical mattresses, and in pipettes. Miniature pumps can also be used in (normally portable) gas analysis devices (respiratory gases, flue gases, etc.). Miniature pressure pumps or miniature vacuum pumps are used outside of medical technology as well, for example in the area of dental technology, in coffee machines, or in industrial applications. It will readily be understood that the aforementioned areas of application are not to be understood as being exhaustive.

Miniature pumps must meet the highest of requirements. These include, in particular, high performance with small overall dimensions. Due to the demands with respect to small design size, and for reasons of economy, electric motors are often used as a drive unit for miniature pumps whose motor and drive shafts are supported in a motor housing with an axial shaft play. Particularly, there is generally no provision of a ball bearing that is able to absorb the axial forces. Sintered bearings that act as slide bushes in linear bearings, for example, can be found in many small electric motors. If there is a change in the position of the motor shaft relative to the horizontal position as a result of movements of the pump and an axial load is exerted on the motor shaft, then the motor shaft can shift in the interior of the motor housing. Parts of the motor shaft can then act in the axial direction against the motor housing or parts thereof or also against a slide bearing provided for radial shaft support, which can lead to vibrations of the motor shaft and/or to noises during operation of the motor. Vibrations and noise generation are undesired in miniature pumps, particularly if the pumps are used close to the body, which is primarily the case in areas of medical technology. It has therefore already been attempted in the prior art to influence the noise and vibration characteristics of the motor shaft in miniature diaphragm pumps and reduce vibrations and/or noises by pretensioning the connecting rod, which acts on a diaphragm of the diaphragm pump and is connected via an eccentric to the motor shaft, particularly by slanting the connecting rod. However, this solution has shown little long-term stability in practice.

It is the object of the present invention to provide a pump assembly, a pump with such a pump assembly, and a method with which low-vibration and low-noise motor operation is ensured while using particularly cost-effective electric motors with motor shafts that are supported in an axially displaceable manner for every installation and/or operating position of the pump. Furthermore, a reduction or elimination of vibrations and/or noises is to be achieved in a structurally simple and cost-effective manner while maintaining the most consistent design size and performance of the pump.

The abovementioned objects are achieved by a pump assembly with the features of claim 1, by a pump with such a pump assembly according to claim 9, and by a method for reducing or eliminating vibrations and/or noises in pumps with the features of claim 10. Advantageous embodiments of the invention are the subject matter of the subclaims.

The pump assembly according to the invention has at least one stabilizing element arranged outside of the motor housing for reducing or for eliminating the axial shaft play of the motor shaft, with an axial compressive force or axial tensile force being applied to the motor shaft by the stabilizing element directly, i.e., through contact, or indirectly, i.e., without contact and/or without touching.

The application of force to the motor shaft thus occurs outside of the motor housing.

The motor shaft is passed through the motor housing on the side of the housing unit connected to the motor housing. The force required to reduce the axial shaft play of the motor shaft is applied to the free end of the motor shaft, particularly on the front side. The motor shaft is supported in the motor housing with an axial shaft play and/or guided in the motor housing with an axial shaft play. This means that the motor shaft can be displaced (slightly) by the stabilizing element relative to the motor housing without the application of force. The invention thus relates to the use of standard motors in which the operation of the pump can result in a relative movement between the motor shaft on the one hand and an outer casing of the electric motor on the other hand.

This relative movement is prevented according to the invention by the at least one stabilizing element.

The electric motor for driving the pump and the motor shaft can consist substantially of a stationary part (stator) and a rotating part (rotor), with the stator and the rotor having permanent magnets or electrical windings that generate electric fields. The rotor is supported on the motor shaft. Moreover, electrical connectors can be provided on at least one electrical consumer or electrical power supply. The electrical connectors are preferably guided out of the motor housing on a side facing away from the housing unit. Otherwise, —that is, with the exception of the feedthroughs for the motor shaft and the electrical connectors—the motor housing is preferably self-contained.

In order to reduce the previously described relative movement between the motor shaft and the motor housing, which is possible, in principle, due to the construction of the electric motor, a stabilizing element is provided according to the invention. The stabilizing element exerts a force, particularly an axial force, that acts indirectly or directly on the free end of the motor shaft received in the housing unit. As a result, the inherently present axial play of the motor shaft is at least reduced, particularly entirely suppressed. The motor housing preferably forms an outer casing of the electric motor and encloses not only electromotive components such as stator and rotor but particularly also shaft bearings of the motor shaft. The electromotive components of the electric motor and the shaft bearings of the motor shaft are particularly encased by the motor housing.

The majority of the motor shaft extends within the motor housing, but one shaft end is passed through an outer wall or front side of the motor housing, with the shaft end that is passed through being preferably arranged within the housing unit. The housing unit preferably encloses the free end of the motor shaft completely. The housing unit can be joined with the motor housing, particularly in a detachable manner, for example by a screw connection. In principle, however, a non-detachable connection can be provided between the housing unit and the motor housing. In particular, the housing unit is preferably connected to the motor housing exclusively in the area of the outer wall or front side through which the motor shaft is passed out of the motor housing. Moreover, it is also possible in principle for the housing unit to also enclose the motor housing, thereby particularly "encapsulating" it.

The housing unit can be embodied in a single- or multi-part configuration. Preferably, the housing unit is a particularly injection-molded plastic component. The housing unit can be connected to the motor housing in a detachable or non-detachable manner.

When the electric motor is in the non-installed state—that is, when the stabilizing element is not (yet) acting on the motor shaft—the axial shaft play of the motor shaft can be preferably less than 2 mm, more preferably less than 1 mm, especially preferably less than 500 μm, or even less than 200 μm. In principle, even a lesser axial shaft play of 50 or 100 μm, for example, can be reduced or suppressed by the stabilizing element provided according to the invention.

The invention thus relates to the retroactive improvement of a standard motor, whose motor shaft is guided in the motor housing so as to inherently have play, for operation in a pump assembly such that the motor shaft is arranged substantially without play in the pump assembly. The categorically possible axial shaft play of the motor shaft of the electric motor must therefore be distinguished from the play-free arrangement of the motor shaft in the installed state of the electric motor and operating state of the pump or within the housing unit.

According to the invention, the expression "outside of the motor housing" is to be understood as referring to all embodiments in which the stabilizing element is arranged outside of the interior space of the motor housing surrounding the motor shaft. In particular, the expression "outside of the motor housing" also includes those embodiments in which the stabilizing element is integrated into the motor housing or forms a part of the motor housing but in which an axial compressive force or axial tensile force is applied by the stabilizing element to the motor shaft from outside of the motor housing in order to reduce or completely eliminate construction-determined shaft play of the motor shaft. The invention is based on the fundamental idea of utilizing the stabilizing element to provide a bearing and/or support for the motor shaft from outside of the motor housing.

The electric motor with motor housing and motor shaft with play represents a structurally preassembled assembly and/or a separate component that is integrated into the pump assembly. According to the invention, no structural modification or alteration of the construction of the electric motor is required to reduce or eliminate the inherent play of the motor shaft. As a result, even when using economical electric motors that have a motor shaft that is supported so as to be displaceable in the axial direction, noises or vibrations for every installation and/or operating position of the pump can be excluded or at least reduced that can otherwise occur during the operation of such motors as a result of relative movements of the motor shaft in relation to the motor housing.

The elimination of the axial shaft play is achieved according to the invention by influencing the stabilizing element in the installed position of the electric motor. At least one stabilizing element can be provided that is fastened in and/or to the housing unit and/or forms a part of the housing unit. Alternatively or in addition, at least one stabilizing element can be provided that is connected to the motor shaft and can be rotated with the motor shaft. Also alternatively or in addition, at least one stabilizing element can be provided that is fastened in and/or to the motor housing and/or forms a part of the motor housing. The stabilizing element can preferably be a separate component that is connected to the housing unit or the motor shaft or the motor housing. In principle, however, the stabilizing element can also be formed by a commensurately embodied housing portion of the housing unit or motor housing. Through the appropriate dimensioning and arrangement of the stabilizing element within the pump assembly, particularly through the defined spacing of the stabilizing element apart from the motor shaft on the drive side of the motor shaft, it is possible to reduce or eliminate noises and/or vibrations while maintaining the same overall size of the pump assembly.

In the invention, a compressive or tensile force acting in the axial direction of the motor shaft is applied to the motor shaft by the stabilizing element. Due to the exertion of force in the axial direction, noises and/or vibrations that occur during motor operation and are attributable to an inherent axial play of the motor shaft can be substantially reduced or even completely eliminated. The forces can result in the pretensioning of the motor shaft in the motor housing and/or in the axial displacement of the motor shaft in the motor housing. Through compressive or tensile forces, the motor shaft can be brought into a position in which it is no longer resting against fixed components of the electric motor during motor operation. The motor shaft can also be pressed by the stabilizing element with a shaft end against a shaft bearing in the motor housing, so that no relevant noises or vibrations occur during motor operation. In order to eliminate the axial shaft play of the motor shaft, a provision can particularly be made that the motor shaft is pressed as a result of the effect of the stabilizing element against a shaft bearing arranged opposite from the drive side of the motor on the interior of the motor housing or pulled against an interior shaft bearing on the drive side of the electric motor. In this context, the method according to the invention makes a provision that an axial compressive or tensile force acting from the outside on the motor shaft is generated in order to reduce or eliminate the axial shaft play. The occurrence of vibrations and/or noises during pump operation can be reduced very effectively or even eliminated completely by exploiting the clearances available on the interior of the housing unit without the need for a structural alteration of the "electric motor" assembly.

In one embodiment of the invention, the stabilizing element can be spring-loaded, or a spring means is provided as a stabilizing element that generates a spring force that acts on the motor shaft in the axial direction of the motor shaft. A housing part of the housing unit or a housing portion of the motor housing can be mechanically coupled with the motor shaft by means of the spring element. For example, a spring element can be provided between the motor housing and an eccentric securely connected to the motor shaft, so that the motor shaft is pressed away from the motor housing or pulled toward the motor housing by the spring force. It will readily be understood that, alternatively, a spring element can also be provided between a housing part of the housing unit and the eccentric of the motor shaft in order to pretension the motor shaft appropriately.

In a preferred embodiment of the invention, the stabilizing element is arranged on the drive side of the electric motor on and/or in a housing part of the housing unit opposite from the freestanding front side of the motor shaft. In particular, the stabilizing element can be arranged on and/or in a housing cover or a housing cap that is connected in a detachable and/or displaceable manner to at least one other housing part of the housing unit. The freestanding part of the motor shaft that projects through the motor housing of the electric motor can be encapsulated in the housing unit when the housing cover is brought into a closing and mounting position. Opening the housing cover enables easy access to the stabilizing element and/or the freestanding shaft end of the motor shaft. In contrast, when the housing cover is in the closed state, the stabilizing element and the free end of the motor shaft are protected against contaminants. The attachment of the stabilizing element to and/or in a housing part opposite from the front side of the motor shaft enables—in a structurally simple manner, and while maintaining the same overall size of the pump—the transmission of sufficient axial compressive and/or tensile forces from the stabilizing element to the motor shaft. The stabilizing element is held securely on or in the housing part.

In a first embodiment of the pump assembly according to the invention, the stabilizing element rests indirectly or directly against the motor shaft on the front side. A contacted reduction of the axial shaft play then occurs, with the motor shaft being forced by the stabilizing element to the side of the motor facing away from the drive side of the electric motor and/or with a pretension being applied that acts in the axial direction to the averted side of the motor.

In order to achieve a low coefficient of sliding friction, the stabilizing element can rest in a substantially punctiform manner against the motor shaft for the purpose of force transmission. Particularly, the stabilizing element can be spherical. Alternatively, a provision can be made that the stabilizing element tapers to a point in the direction of the drive side of the electric motor, so that the stabilizing element acts with its tip against the motor shaft. This also ensures a low coefficient of sliding friction during the rotation of the motor shaft.

Alternatively or in addition, the resistance caused by sliding friction between the stabilizing element and the motor shaft can be kept low through the selection of a low-friction combination of materials. In this context, the stabilizing element can be made of a material with good sliding and wear characteristics, such as polyoxymethylene (POM) and/or polytetrafluoroethylene (PTFE). The above-mentioned materials also enable the stabilizing element to be manufactured cost-effectively. In principle, however, it is also possible to fabricate the stabilizing element from a ceramic material and/or carbon in order to ensure a low coefficient of sliding friction between the stabilizing element and the motor shaft.

In order to minimize loss of efficiency on the part of the pump due to the application of force of the motor shaft with the stabilizing element, the stabilizing element can also be held or supported in a rotating manner on the housing part. During motor operation, relative movement can occur between the stabilizing element and the housing part due to the motor shaft resting against the stabilizing element, and the stabilizing element can be moved along with the motor shaft.

In addition, it will readily be understood that a stabilizing element can also be held against a housing portion of the motor housing that abuts against an eccentric connected to the free end of the motor shaft and/or acts against the eccentric. A compressive force can then be exerted via the stabilizing element on the eccentric in order to press the motor shaft in a direction facing away from the motor housing, thereby reducing the axial shaft play. Here, too, the stabilizing element can be preferably punctiform, more preferably spherical. Moreover, the stabilizing element can also be held in a rotating manner on the housing portion of the motor housing and/or be made of a low-wear material.

For the long-term stability of a transmission of compressive forces from the stabilizing element to the motor shaft, a spring force can be applied to the stabilizing element. The stabilizing element can be pretensioned by a spring element in the axial direction toward the motor shaft. This ensures that there is always active contact between the stabilizing element and the motor shaft, even when wear occurs on the stabilizing element as a result of a rotatory relative movement occurring during motor operation between the motor shaft and the stabilizing element resting against the motor shaft.

To generate the spring force, a diaphragm made of an elastic plastic can be provided on a housing part of the housing unit, for example, that rests against the stabilizing element and is pressed by the stabilizing element toward the motor shaft. Alternatively, the housing part itself can also be made of an elastomeric plastic and pretension the stabilizing element. Also alternatively, a spring element, such as a coil spring, for example, can also be provided in order to press the stabilizing element against the motor shaft.

In an alternative embodiment of the invention, a magnetic coupling can be provided between the motor shaft and the housing unit and/or between the motor shaft and the motor housing in order to reduce or eliminate the axial shaft play of the motor shaft. The coupling is passed from outside the motor housing, which is itself closed, to the shaft end of the motor shaft passed out of the motor housing. In this embodiment, the motor shaft is held by magnetic field forces in a contactless manner in a certain axial position in order to reduce or eliminate shaft play. A magnetic field is generated in the axial direction that attracts or repels the motor shaft in order to reduce and, preferably, to eliminate the axial shaft play inherent to the "electric motor" assembly. As a result of the magnetic coupling, a frictionless and thus wear-free transmission that approaches zero efficiency loss of the forces required to reduce or eliminate the axial shaft play of the motor shaft is possible. Moreover, a magnetic coupling is easy to design structurally and can be manufactured economically.

In order to generate a sufficiently strong magnetic field independently of a power supply, at least one permanent magnet—embodied, for example, as a disc magnet or ring magnet—can be provided as a stabilizing element, or the stabilizing element can have at least one such permanent magnet. Electromagnetic coupling is also possible in principle. For example, a magnetic stabilizing element can be arranged or held in and/or on the housing unit and/or in and/or on the motor housing, or a magnetic stabilizing element can be connected directly to the motor shaft. To form the magnetic coupling, at least two magnetic stabilizing elements can act together, or a stabilizing element can act together with a region or portion or part of the housing unit or of the motor housing or of the motor shaft that is made of a ferromagnetic material. For example, a ring magnet arranged concentrically with the motor shaft and connected securely to the motor shaft can be provided that acts together with another permanent magnet attached to the housing unit or motor housing. Opposing magnetic poles of the stabilizing element can have the same or opposite polarity in order to push the stabilizing elements away from one another or have them be mutually attracted.

A permanent magnet as a stabilizing element can be arranged concentrically with the motor shaft. Moreover, it is possible for a permanent magnet to be arranged so as to be radially offset in relation to the motor shaft with the additional function of a counterweight. In an eccentric pump with an eccentric connected to the free end of the motor shaft, at least one magnet can be integrated into the eccentric in place of a stabilizing element. If counterweights in the eccentric are made of a ferromagnetic material, they can act together with a permanently magnetic stabilizing element connected to the housing unit or the motor housing in order to achieve a magnetic coupling between the housing unit and the motor shaft or between the motor housing and the motor shaft. A disc made of a ferromagnetic material can also be securely connected to the free end of the motor shaft that is attracted, for example, by a permanently magnetic stabilizing element on the housing unit or by a permanently magnetic stabilizing element on the motor housing in order to move the motor shaft in a defined direction and reduce the axial play of the motor shaft.

The invention is illustrated in further detail on the basis of exemplary embodiments.

Figure 1:
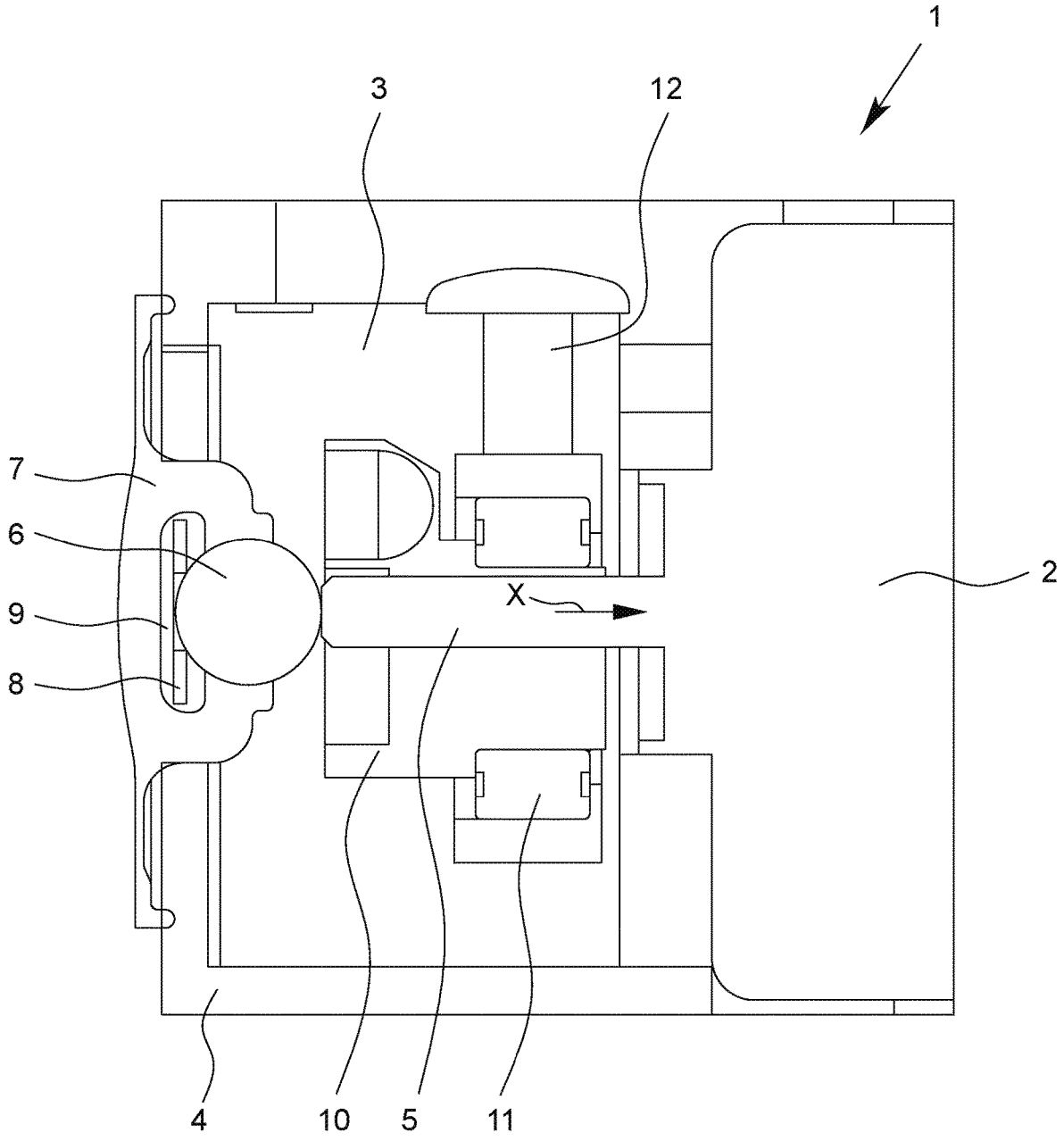
FIG. 1 shows a schematic view of a first embodiment of a pump assembly according to the invention with a housing unit and an electric motor, with a mechanical coupling being provided between the housing unit and a motor shaft of the electric motor.

FIG. 1 shows a schematic and cutaway illustration of a pump assembly 1 for a miniature diaphragm pump or eccentric diaphragm pump having an electric motor 2 and a multipart housing unit 3. The diaphragm pump is suitable as a drainage pump for suctioning off bodily fluids or gases in the vicinity of a wound, for example. A part of the housing unit 3 forms a housing cover 4. The electric motor 2 has a motor shaft 5 passing freely through a motor housing (not shown in further detail) of the electric motor 2. The electric motor 2 with motor shaft 5 and motor housing forms an independent structural unit, which is shown in an installed position in FIG. 1. The motor housing is screwed to the housing unit 3. It is also not shown that the motor shaft 5 is supported in the motor housing with an axial shaft play; in particular, a slide bearing and not a ball bearing of the motor shaft 5 is provided which can also absorb axial forces.

On a drive side of the electric motor 2, the motor housing has a housing opening for the motor shaft 5 through which the motor shaft 5 is guided. The motor shaft 5 can be supported by means of sintered bearings that are designed merely to absorb radial forces. In such electric motors 2, components can be provided on the motor shaft 5 that rotate together with the motor shaft 5 and act axially against the motor housing or a shaft bearing in the motor housing depending on the arrangement and alignment of the electric motor 2 during pump operation. This can result in bothersome vibrations and noises. As a result of the connection of the electric motor 2 to the housing unit 3, vibrations are transferred to the housing unit 3 and, particularly when it is necessary to arrange the diaphragm pump near the body during pump operation, are perceived as an annoyance.

In order to prevent vibrations and/or noises, for example if the eccentric diaphragm pump is tilted when the motor shaft 5 is moved out of a horizontal position, for example, the depicted pump assembly 1 has a stabilizing element 6 which, in the form of a sphere, acts as a support bearing for the motor shaft 5 and rests against the free end of the motor shaft 5 directly on the front side. The motor shaft 5 is forced by the stabilizing element 6 in the axial direction X (FIG. 1) to the side opposite from the drive side of the electric motor 2 and a pretension is produced in this direction, which results in a reduction of the axial shaft play of the motor shaft 5 in the motor housing.

As can also be seen from FIG. 1, the stabilizing element 6 is held with a diaphragm 7 made of an elastic plastic on the housing cover 4 and pretensioned in the direction of the motor shaft 5. Instead of the diaphragm 7, another spring means can also be provided. The diaphragm 7 is connected to the housing cover 4. In order to prevent the stabilizing element 6 from being pressed into the diaphragm 7 and to thus enable sufficient compressive force to be applied to the motor shaft 5 in the axial direction X in a manner that has long-term stability, a support ring 8 made of metal can be provided, which is placed or pushed into a diaphragm pocket 9.

The motor shaft is connected in a torque-proof manner that is in itself customary to the eccentric 10. The eccentric 10 is also connected by means of a ball bearing 11 in a manner that is in itself customary to a connecting rod 12 in order to establish a connection to a diaphragm (not shown) of the diaphragm pump and ensure the pump function.

Figure 2:
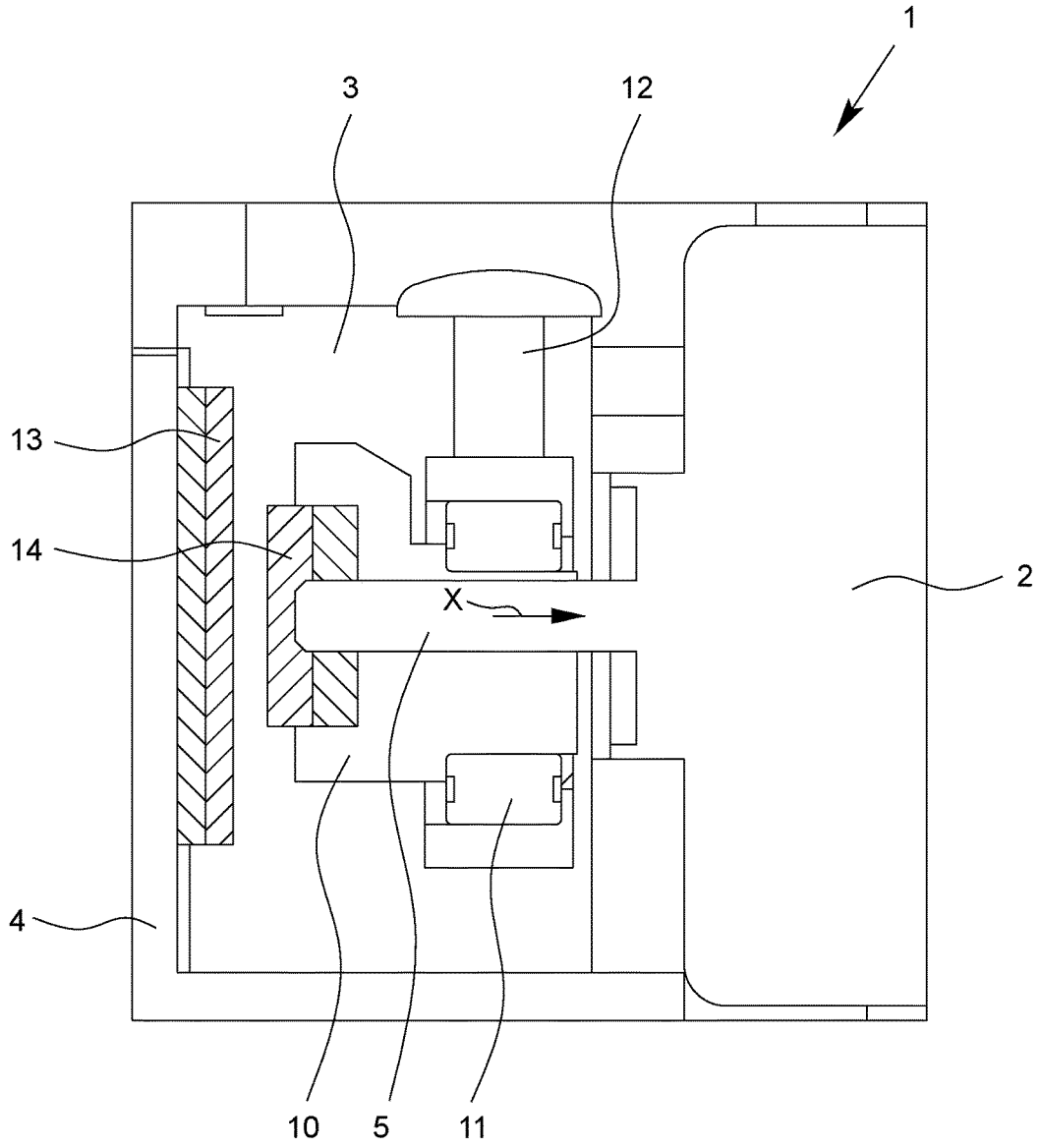
FIG. 2 shows a schematic view of a second embodiment of a pump assembly according to the invention with a magnetic coupling between the housing unit and the motor shaft.

FIG. 2 shows an alternative embodiment of a pump assembly 1 of a diaphragm pump. Same reference symbols in FIGS. 1 and 2 designate same components, for which reason reference is made here to the foregoing description of these components.

Unlike the pump assembly 1 depicted in FIG. 1, in order to reduce or eliminate the axial shaft play of the motor shaft 5 according to FIG. 2, a magnetic coupling is provided between a stabilizing element 13 disposed on the inside of the housing cover 4 and another stabilizing element 14 disposed concentrically with the motor shaft 5. The additional stabilizing element 14 can also be arranged so as to be offset in relation to the motor shaft 5 with the additional function of a counterweight. The stabilizing element 13 is preferably a disc magnet. The additional stabilizing element 14 is preferably a ring magnet. Since the stabilizing elements 13, 14 are equally polarized on opposing sides, the motor shaft 5 is repelled by the stabilizing element 13 and thus forced in the direction X to the side of the motor opposite from the drive side of the electric motor 2. This reduces, and preferably completely eliminates, axial bearing clearance of the motor shaft 4 in the motor housing.

Incidentally, it will be readily understood that the stabilizing element 13 and the additional stabilizing element 14 can also be polarized differently on the mutually facing sides, so that the motor shaft 5 is pulled toward the housing cover 4, which, depending on the structural design of the shaft bearing in the electric motor 2, can also result in the reduction, and preferably the complete elimination, of an inherent axial bearing play of the motor shaft 5 within the motor housing.

The additional stabilizing element 14 is integrated into the eccentric 10 on the front side. For this purpose, the eccentric 10 has a corresponding annular groove into which the additional stabilizing element 14 is inserted. The concentric arrangement of the ring magnet contributes to a highly smooth operation on the part of the electric motor 2.

Something that is not shown is that the eccentric 10 can have counterweights—which can be formed by permanent magnets—arranged so as to be offset on the front side in relation to the motor shaft, with these counterweights being provided as stabilizing elements. A magnetic coupling between the housing unit 3 and the motor shaft 5 can be achieved in this way, too.

It is also possible for only one stabilizing element 13, 14 to be provided that acts together with a ferromagnetic region, portion, or part of the housing cover 4 or of the motor shaft 5. In the embodiment shown in FIG. 2, for example, instead of the stabilizing element 13, a disc made of a ferromagnetic material can be arranged on the inside of the housing cover 4, thus causing the motor shaft 5 to be pulled toward the housing cover 4 counter to the axial direction X shown in FIG. 2. In order to pull the motor shaft 5 in the axial direction X, a commensurately designed ferromagnetic region can also be provided on the motor housing. Alternatively, instead of the additional stabilizing element 14, it is also possible to provide a disc made of a ferromagnetic material connected in an appropriate location to the motor shaft 5, so that the disc and thus the motor shaft 5 is pulled toward the magnetic stabilizing element 13 on the housing cover 4.

Alternatively, a magnetic field can also be generated between a permanent magnet fixed on the eccentric 10 and a permanent magnet fixed on the motor housing in order to reduce or eliminate axial play of the motor shaft 5.

Figure 3:
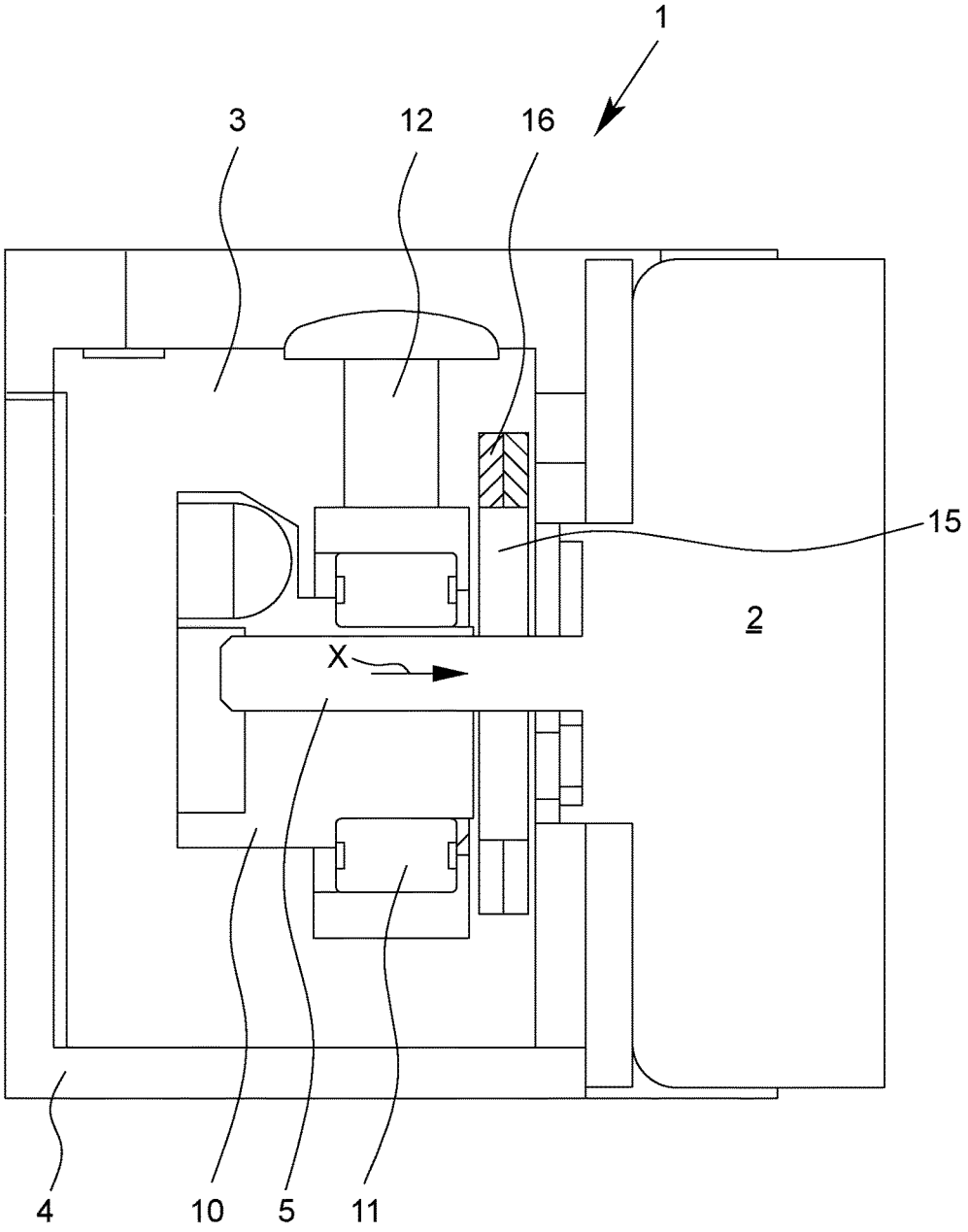
FIG. 3 shows a schematic view of another embodiment of a pump assembly according to the invention with a magnetic coupling between the motor shaft and the motor housing.

FIG. 3 shows another embodiment of a pump assembly 1 for an eccentric diaphragm pump; here as well, same reference symbols in FIGS. 1, 2, and 3 designate same components, for which reason reference is made here to the foregoing description of these components.

In the embodiment shown in FIG. 3, a disc 15 is provided that is connected securely radially inwardly to the motor shaft 5 and securely radially outwardly to a ring magnet as a stabilizing element 16. The disc 15 is arranged at the free end of the motor shaft 5 guided through the motor housing of the electric motor 2 adjacent to the motor housing. For a magnetic coupling, the motor housing can be made of a magnetizable (ferromagnetic) material. A cover plate or fixing screws or the like can also be made of a magnetizable material. This means that the motor shaft 5 is pulled in the axial direction X to the motor housing, which, in turn, can result in a reduction or the elimination of the inherent axial play of the shaft. Here, too, it will readily be understood that an additional magnetic stabilizing element can be provided in the vicinity of the motor housing in order to attract (or repel) the stabilizing element 16 connected to the motor shaft 5 even more strongly and to bring about a displacement of the motor shaft 5 into one or the other direction.

LIST OF REFERENCE SYMBOLS

| | |
|---|---|
| 1 | pump assembly |
| 2 | electric motor |
| 3 | housing unit |
| 4 | housing cover |
| 5 | motor shaft |
| 6 | stabilizing element |
| 7 | diaphragm |
| 8 | support ring |
| 9 | diaphragm pocket |
| 10 | eccentric |
| 11 | ball bearing |
| 12 | connecting rod |
| 13 | stabilizing element |
| 14 | stabilizing element |
| 15 | disc |
| 16 | stabilizing element |

The invention claimed is:

1. An eccentric diaphragm pump with a diaphragm and a pump assembly, wherein the pump assembly comprises an electric motor and a housing unit, wherein the electric motor has a motor shaft passing freely through a motor housing of the electric motor and the motor housing is connected to the housing unit, and wherein the motor shaft is supported in the motor housing with an axial shaft play, wherein the electric motor with motor shaft and motor housing forms an independent structural unit, wherein a majority of the motor shaft extends within the motor housing, but one freestanding shaft end of the motor shaft is passed through an outer wall or front side of the motor housing into an interior space of the housing unit, so that the freestanding shaft end of the motor shaft is completely enclosed by the housing unit, wherein the motor shaft is connected to an eccentric within the housing in a torque-proof manner, wherein the eccentric is also connected by a ball bearing to a connecting rod in order to establish a connection to the diaphragm and to ensure pump function, wherein at least one stabilizing element arranged outside of the motor housing is provided in order to reduce or to eliminate the axial shaft play of the motor shaft, wherein an axial compressive force or axial tensile force acting on the motor shaft is applied by the at least one stabilizing element to the motor shaft, wherein the at least one stabilizing element is provided so that it is fastened in the housing unit, wherein the at least one stabilizing element is arranged in a housing part of the housing unit and wherein a first portion of the at least one stabilizing element is fixed by the housing part in an orientation axially opposite from the freestanding shaft end of the motor shaft.

2. The pump assembly as set forth in claim 1, wherein a second portion of the at least one stabilizing element is provided so that it is rotatably connected to the motor shaft.

3. The pump assembly as set forth in claim 1, wherein, in order to reduce or eliminate the axial play of the motor shaft, a magnetic coupling is provided between the motor shaft and the housing unit and/or between the motor shaft and the motor housing.

4. The pump assembly as set forth in claim 1, wherein a permanent magnet is provided as the at least one stabilizing element or the at least one stabilizing element includes at least one permanent magnet.

5. The pump assembly as set forth in claim 1, wherein, in order to create a magnetic coupling, at least two magnetic stabilizing elements act together or the at least one stabilizing element acts together with a region or portion or part of the housing unit or of the motor housing or of the motor shaft that is made of a ferromagnetic material.

6. A pump with the pump assembly as set forth in claim 1, wherein the pump is a pump with a delivery volume of less than 10 L/min.

7. A pump with the pump assembly as set forth in claim 1, wherein the pump is a pump with a delivery volume of less than 1000 mL/min.

8. A pump with the pump assembly as set forth in claim 1, wherein the pump is a pump with a delivery volume of less than 500 mL/min.

9. A method for reducing or eliminating vibrations and/or noises in eccentric diaphragm pumps, comprising a diaphragm and a pump assembly with an electric motor and with a housing unit, wherein the electric motor has a motor shaft passing freely through a motor housing of the electric motor and the motor housing is connected to the housing unit, and wherein the motor shaft is supported in the motor housing with an axial shaft play, wherein the electric motor with motor shaft and motor housing forms an independent structural unit, wherein a majority of the motor shaft extends within the motor housing, but one freestanding shaft end of the motor shaft is passed through an outer wall or front side of the motor housing into an interior space of the housing unit, so that the freestanding shaft end of the motor shaft is completely enclosed by the housing unit, wherein the motor shaft is connected to an eccentric within the housing in a torque-proof manner, wherein the eccentric is also connected by a ball bearing to a connecting rod in order to establish a connection to the diaphragm and to ensure to pump function, wherein the method includes the step of providing an axial compressive force or axial tensile force from outside of the motor housing on the motor shaft with at least one stabilizing element in order to reduce or eliminate the axial shaft play, wherein the at least one stabilizing element is provided so that it is fastened in the housing unit, wherein a first portion of the at least one stabilizing element is arranged in a housing part of the housing unit and wherein the at least one stabilizing element is fixed by the housing part in an orientation axially opposite from the freestanding shaft end of the motor shaft.

10. The method of claim 9, wherein the pump assembly is a pump with a delivery volume of less than 10 L/min.

11. The method of claim 9, wherein the pump assembly is a pump with a delivery volume of less than 1000 mL/min.

12. A diaphragm pump with a diaphragm and a pump assembly, wherein the pump assembly comprises an electric motor and a housing unit, wherein the electric motor has a motor shaft passing freely through a motor housing of the electric motor and the motor housing is connected to the housing unit, and wherein the motor shaft is supported in the motor housing with an axial shaft play, wherein the electric motor with the motor shaft and motor housing forms an independent structural unit, wherein a majority of the motor shaft extends within the motor housing, but one freestanding shaft end of the motor shaft is passed through an outer wall or front side of the motor housing into an interior space of the housing unit, so that the freestanding shaft end of the motor shaft is completely enclosed by the housing unit, wherein the diaphragm is driven by the motor shaft within the housing unit in order to ensure pump function, wherein at least one stabilizing element arranged outside of the motor housing is provided in order to reduce or to eliminate the axial shaft play of the motor shaft, wherein an axial compressive force or axial tensile force acting on the motor shaft is applied by the at least one stabilizing element to the motor shaft, wherein the at least one stabilizing element is provided so that it is fastened in the housing unit, wherein the at least one stabilizing element is arranged in a housing part of the housing unit and wherein a first portion of the at least one stabilizing element is fixed by the housing part in an orientation axially opposite from the freestanding shaft end of the motor shaft.

* * * * *